US010492549B2

(12) United States Patent
Maier

(10) Patent No.: US 10,492,549 B2
(45) Date of Patent: Dec. 3, 2019

(54) CYCLING JACKET

(71) Applicant: ASSOS OF SWITZERLAND S.A., San Pietro di Stabio (CH)

(72) Inventor: Roger Maier, Carona (CH)

(73) Assignee: ASSOS OF SWITZERLAND GMBH, San Pietro di Stabio (CH)

( * ) Notice: Subject to any disclaimer, the term of this patent is extended or adjusted under 35 U.S.C. 154(b) by 165 days.

(21) Appl. No.: 14/925,176

(22) Filed: Oct. 28, 2015

(65) Prior Publication Data

US 2016/0120244 A1 May 5, 2016

(30) Foreign Application Priority Data

Oct. 30, 2014 (EP) ..... 14191043

(51) Int. Cl.

| | |
|---|---|
| ***A41D 27/04*** | (2006.01) |
| ***A41D 3/02*** | (2006.01) |
| ***A41D 1/04*** | (2006.01) |
| ***A41D 3/00*** | (2006.01) |
| ***A41D 13/00*** | (2006.01) |
| *A41D 13/05* | (2006.01) |

(52) U.S. Cl.

CPC ..... *A41D 27/04* (2013.01); *A41D 1/04* (2013.01); *A41D 3/00* (2013.01); *A41D 3/02* (2013.01); *A41D 13/0015* (2013.01); *A41D 13/0518* (2013.01); *A41D 2300/322* (2013.01); *A41D 2400/422* (2013.01); *A41D 2600/104* (2013.01)

(58) Field of Classification Search

CPC . A41D 27/04; A41D 3/00; A41D 3/02; A41D 1/02; A41D 2600/104; A41D 2400/422

See application file for complete search history.

(56) References Cited

U.S. PATENT DOCUMENTS

| | | | | | |
|---|---|---|---|---|---|
| 1,645,995 | A | * | 10/1927 | McCarthy | A41D 13/0518 2/92 |
| 1,915,597 | A | * | 6/1933 | Ducker | A41D 1/04 2/95 |
| 2,306,154 | A | * | 12/1942 | Bryant | A41D 1/02 2/95 |
| 2,594,259 | A | * | 4/1952 | Fitch | A41D 27/04 2/265 |
| 4,149,272 | A | * | 4/1979 | Maeshima | A41D 3/00 2/102 |
| 4,217,663 | A | * | 8/1980 | Goldberg | A41D 3/00 2/102 |
| 4,470,155 | A | * | 9/1984 | Maeshima | A41D 27/04 2/102 |

(Continued)

FOREIGN PATENT DOCUMENTS

| | | |
|---|---|---|
| DE | 3623583 A1 | 1/1988 |
| GB | 2385257 A | 8/2003 |

OTHER PUBLICATIONS

European Search Report from EP 14191043 completed Feb. 23, 2015.

*Primary Examiner* — Megan Lynch

(74) *Attorney, Agent, or Firm* — Fox Rothschild LLP

(57) ABSTRACT

Cycling jacket or vest (1) comprising an incorporated wind-proof panel (5) fixed internally; said panel is foldable inside a containing pocket (4) and, in position for use, is arranged substantially as an inner lining of the front part of the jacket or vest so as to protect the torso of the user.

7 Claims, 1 Drawing Sheet

(56) References Cited

U.S. PATENT DOCUMENTS

Figure 1:
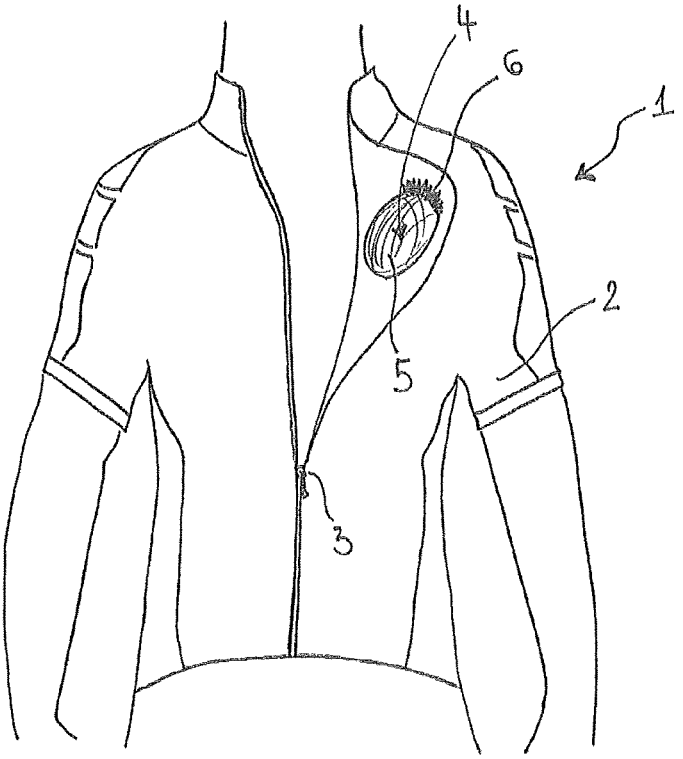

| | | | | |
|---|---|---|---|---|
| 5,040,243 | A * | 8/1991 | Tatsuno | A41D 3/00 2/108 |
| 5,077,838 | A * | 1/1992 | Senser | A41D 15/00 2/102 |
| 5,115,516 | A * | 5/1992 | Golde | A41D 3/00 2/102 |
| 5,361,523 | A * | 11/1994 | Robinson | A41D 27/08 2/95 |
| 5,774,891 | A | 7/1998 | Boyer | |
| 6,665,878 | B1 * | 12/2003 | Way | A41D 3/02 2/84 |
| 6,851,128 | B1 * | 2/2005 | Parrotte | A41D 3/00 2/108 |
| 7,392,549 | B1 * | 7/2008 | Barber | A41D 13/0012 2/269 |
| 2003/0126675 | A1 * | 7/2003 | Blauer | A41D 3/00 2/456 |
| 2004/0154076 | A1 * | 8/2004 | Yoo | A41D 27/04 2/247 |
| 2005/0150031 | A1 | 7/2005 | Schrader | |
| 2009/0070914 | A1 * | 3/2009 | Landeck | A41D 1/02 2/95 |
| 2010/0287680 | A1 * | 11/2010 | Johnson | B32B 27/12 2/87 |
| 2013/0067631 | A1 * | 3/2013 | Crye | A41D 3/00 2/85 |
| 2015/0106995 | A1 * | 4/2015 | Ampofo | A41B 1/22 2/119 |

* cited by examiner

CYCLING JACKET

CROSS REFERENCE TO RELATED APPLICATIONS

This U.S. Application claims priority to European Application No.: 14191043.0 filed Oct. 30, 2014, entitled "CYCLING JACKET" the entirety of which is incorporated herein by reference.

The invention relates to the field of cycling garments, in particular to a cycling jacket or vest.

In the field of clothing used for cycling, there exist garments intended for a wide range of climatic conditions. However, even assuming constant climatic conditions, the thermal stress may vary significantly depending on the nature of the road travelled along (e.g. uphill or downhill), the speed and exposure to wind.

A typical example consists in mixed road conditions comprising uphill and downhill sections. When cycling uphill a cyclist tends to get hot owing to the effort and the reduced speed and sweats profusely; when travelling downhill, instead, the cyclist is exposed to sudden and intense cooling by the external air. This cooling effect is even more felt because of the high speed downhill. The part of the body which is most exposed is the torso, owing to the broad surface area which is directly exposed to the air and the sensitivity to the cold, which is greater than that of the limbs.

During a normal mild day, for example, cycling uphill requires light clothing, preferably comprising a short-sleeved vest, while when travelling downhill there is the need for greater protection at least for the torso.

According to the state of the art no practical solution is offered to this problem. Cycling vests provided with an inner windproof membrane (known as "membrane vests") which entirely lines the inside of the vest are known. However, they are suitable only for low temperatures, otherwise they are too hot and become uncomfortable when the cyclist is under intense effort uphill.

In order to deal with mixed road conditions with uphill and downhill sections, the solution which is universally employed by cyclists is that of wearing a light vest, while carrying a windproof jacket to be used if necessary. Therefore, for example, once reached the top of a hill, the cyclist wears the windproof jacket before facing the downhill section. This solution, however, is not very practical: wearing a windproof jacket takes time and distracts the cyclist; furthermore the windproof jacket, when not used, is bulky.

These problems affect both amateur cyclists and even more so cyclists who practise competitive cycling. During a competitive race, wearing a jacket after reaching the top of a hill may cause a loss of time, because the cyclist should immediately focus on tackling the downhill section so as not being distanced by the other cyclists.

Some cyclists, even nowadays, use the makeshift measure of putting a newspaper underneath the vest, in order to protect the chest from the wind. This is even more surprising when one considers the level of sophistication which has been attained by sports clothing for cycling, and highlights how the problem forming the basis of the invention has not been solved yet.

The object of the invention is to provide a solution to this problem. The idea forming the basis of the invention is to provide a cycling vest with an incorporated windproof protection system, in particular for the cyclist's torso, which can be used only when needed.

The object is achieved by means of a cycling jacket or vest comprising a windproof panel fixed inside the said vest and foldable inside a containing pocket, wherein said panel, once extracted from said containing pocket and unfolded, is arranged substantially as an inner lining of the front part of the jacket or vest, and is sized so as to cover the torso of the user.

Hereafter, for the sake of simplicity, the term "vest" will be used, although the invention is to be understood as referring to a vest or jacket.

Preferably, said windproof panel is fixed to the vest only on the top part thereof, more preferably in the region of the containing pocket. For example the panel comprises an edge portion which is stitched or fixed on the inside of the vest using some other technique known per se. The bottom edge and the side edges of the panel are advantageously free. Said panel, once extracted and unfolded, is kept in position by the vest itself, closed over the panel, and by the torso of the cyclist.

Advantageously the windproof panel covers only the torso of the user, i.e. the front part of the body. Windproof protection for the back is in fact not required.

The mode of use is now described. The cyclist, in conditions of greater effort and less ventilation (typically when cycling uphill) may leave the protection panel folded up inside the dedicated pocket; when the cyclist expects to be more exposed to air and cooling (typically cycling downhill), he/she opens the vest, pulls out the protection panel, positions it unfolded over the front of the torso, down to the belly area, and closes up the vest again.

Preferably, the vest is provided with a zip fastener which facilitates the operation of opening the vest, extracting the panel and closing the vest over the panel. Said operations are therefore possible in a few seconds, without the cyclist being distracted from the pedaling action and without a significant loss of time. Another advantage of the invention is that the windproof panel, when it is not used, i.e. is folded up inside the containing pocket, has a volume which is practically unnoticeable and does not bother the user.

The panel is preferably made of a material which acts as a wind barrier, for example a suitable fabric. More advantageously, said material has a low air-permeability. Examples of preferred materials are polyamide (PA), polyester (PE) and mixtures thereof. A preferred material is polyamide or a material comprising polyamide in a large percentage amount, i.e. greater than 50%. The material of the panel is advantageously light, for example in the preferred embodiments it has a weight not greater than 100 $g/m^2$ and more preferably of 50 $g/m^2$ or about 50 $g/m^2$. The material may be elasticized or non-elasticized.

More preferably, the vest or jacket is made of light fabric. This is particularly advantageous because, precisely in relatively high temperature conditions, the big difference in thermal stress when cycling uphill and downhill is noticeable. In fact, when cycling uphill the cyclist suffers more easily from the heat and prefers light clothing, while when cycling downhill, even in mild temperature conditions, the high speed in any cases results in substantial cooling of the body, and the additional protective panel, incorporated in the vest, reveals to be particularly useful.

The invention is now described with reference to FIGS. 1 and 2 which illustrate a preferred embodiment thereof.

FIG. 1 shows a cycling vest 1 with short sleeves 2 and with a front zip fastener 3. The vest 1 is provided internally with a pocket 4 containing an additional protection panel 5, which is normally folded up inside the pocket 4. Said panel 5 is for example a thin sheet of windproof textile material, with low air permeability.

The panel 5 has a top edge part fixed inside the vest 1, preferably close to the pocket 4 or inside the pocket 4 itself.

Figure 2:
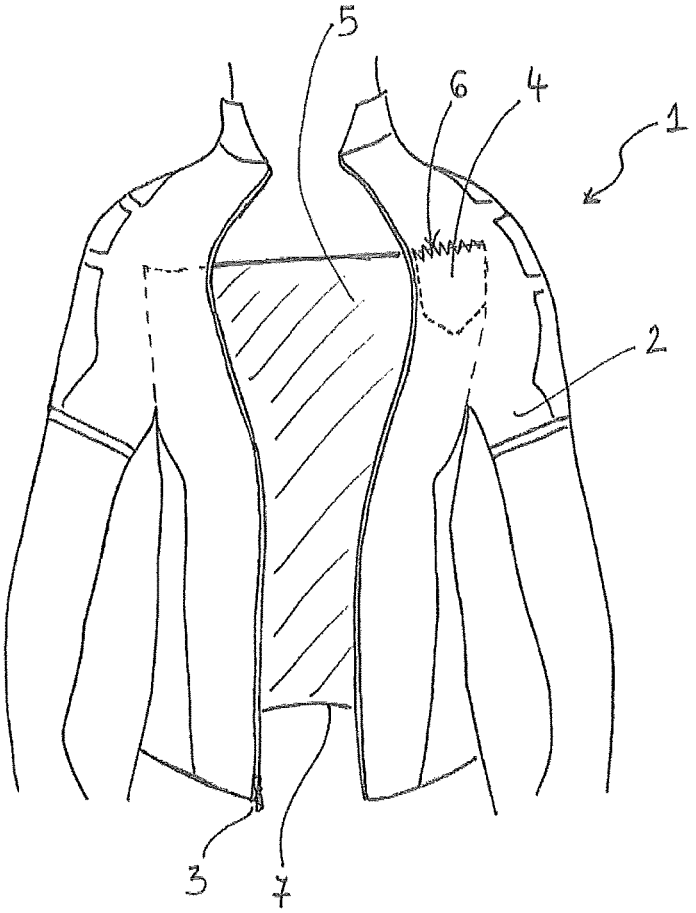

FIG. 2 shows the panel 5, in position during use, extracted from the pocket 4. As shown, said panel 5 has an edge portion 6 stitched inside the vest 1, for example a portion of the top edge or a corner portion between the top edge and an adjacent side edge. The remaining side edges (shown in dotted lines in FIG. 2) and the bottom edge 7 are free.

Once unfolded, the panel 5 substantially has the same surface area as the front part of the vest 1 and covers the user's torso. Once the vest 1 has been closed up again using the zip fastener 3, the panel 5 remains in position being retained by the vest itself against the user's body and acts as an inner windproof lining. Said lining, however, is used only when needed, for example along a downhill section. When no longer needed, the panel 5 may be folded up again and placed back inside the pocket 4.

The invention thus achieves the objects mentioned above, providing a versatile garment, in particular suitable for cycling along roads of a mixed nature, i.e. with alternating uphill and downhill sections.

The invention claimed is:

1. A cycling jacket or vest comprising a windproof panel fixed inside said jacket or vest and foldable inside an inner containing pocket of said jacket or vest, the panel having a horizontal top terminal edge, a horizontal bottom terminal edge, and first and second longitudinal terminal edges, wherein said panel, when in position for use, extracted from said containing pocket and unfolded, is arranged substantially as an inner lining of the front part of the jacket or vest and is sized so as to be configured to cover only a front part of a user's torso, the horizontal top and bottom terminal edges configured to extend from one front side of the torso to the other front side of the torso, the first and second longitudinal terminal edges configured to extend from a bottom front of the torso to a top front of the torso, wherein only an upper corner edge portion of the windproof panel is permanently stitched inside the jacket or vest.

2. The cycling jacket or vest according to claim 1, the windproof panel being permanently stitched inside the jacket or vest solely in the region of said containing pocket.

3. The cycling jacket or vest according to claim 1, said panel being in the form of a sheet of windproof material.

4. The cycling jacket or vest according to claim 2, said material of the windproof panel having a weight of not more than 100 $g/m^2$.

5. The cycling jacket or vest according to claim 3, said windproof panel being made of polyamide, polyester or mixtures thereof.

6. The cycling jacket or vest according to claim 1, having a front closing formed with a zip fastener.

7. The cycling jacket or vest according to claim 4, wherein said material of the windproof panel has a weight equal to about 50 $g/m^2$.

* * * * *